US009334823B2

(12) United States Patent
Christ et al.

(10) Patent No.: US 9,334,823 B2
(45) Date of Patent: May 10, 2016

(54) CONTROLLER FOR AN INJECTION SYSTEM

(71) Applicant: Liebherr Machines Bulle SA, Bulle (CH)

(72) Inventors: Konrad Christ, Bulle (CH); Francois Masson, Villers-sur Glane (CH); Richard Pirkl, Bulle (CH)

(73) Assignee: Liebherr Machines Bulle SA, Bulle (CH)

( * ) Notice: Subject to any disclaimer, the term of this patent is extended or adjusted under 35 U.S.C. 154(b) by 217 days.

(21) Appl. No.: 14/256,463

(22) Filed: Apr. 18, 2014

(65) Prior Publication Data

US 2014/0311457 A1 Oct. 23, 2014

(30) Foreign Application Priority Data

Apr. 19, 2013 (CH) ..... 803/13

(51) Int. Cl.
*F02D 41/30* (2006.01)
*F02D 41/14* (2006.01)
*F02D 41/24* (2006.01)

(52) U.S. Cl.
CPC ..... *F02D 41/30* (2013.01); *F02D 41/1402* (2013.01); *F02D 41/2467* (2013.01)

(58) Field of Classification Search
CPC ..... F02D 14/30; F02D 41/14; F02D 29/02; F02D 29/00; F02D 41/1402; F02D 41/2467; F02D 41/3035
See application file for complete search history.

(56) References Cited

U.S. PATENT DOCUMENTS 8,838,348 B2 * 9/2014 Oouchida ..... B60W 10/06 477/37
8,903,633 B2 * 12/2014 Sasaki ..... F02D 35/026 701/101
9,068,520 B2 * 6/2015 Masuda ..... F02D 29/02
2011/0202255 A1 8/2011 Hauser

FOREIGN PATENT DOCUMENTS

DE 10 2008 051 820 A1 4/2010
DE 197 26 100 B4 2/2011

* cited by examiner

*Primary Examiner* — Hieu T Vo
(74) *Attorney, Agent, or Firm* — Crowell & Moring LLP

(57) ABSTRACT

A controller for an injection system having a plurality of fuel injectors includes a map controller. From a desired injection value, the map controller generates a control value for actuating a fuel injector with reference to a specified map. A determination unit determines the actual injection value for at least one injection made, and an adaption unit uses results from the determination unit in order to adapt actuation of the fuel injectors. The adaption unit determines an adaption value for injector actuation from the at least one actual injection value. In engine operation, the adaption unit receives the control values generated by the map controller as input. From this input, the adaption unit generates adapted actuation values as output by applying a mathematical function to the control values generated by the map controller. The at least one adaption value is included in the first mathematical function as parameter.

20 Claims, 4 Drawing Sheets

CONTROLLER FOR AN INJECTION SYSTEM

This application claims priority to Swiss patent application 00803/13, filed Apr. 19, 2013, the entire disclosure of which is incorporated herein by reference.

BACKGROUND OF THE INVENTION

1. Field of the Invention

The present invention relates to a controller for an injection system with a plurality of fuel injectors, a common fuel supply line for the fuel injectors, and a high-pressure pump for supplying the common fuel supply line with fuel. The controller is particularly applicable to a common-rail injection system of a diesel engine.

The precise dosage of the injected fuel quantity plays an essential role with regard to subsequent combustion and the resulting exhaust gases in engine actuation. Due to production-related component variances of the fuel injectors and aging phenomena during engine operation, the same must be calibrated while the engine is running. This means that deviations or drifts in the actually injected fuel quantity must be detected, quantified, and compensated by a corresponding adaptation of the injector actuation.

2. Description of Related Art

The actuation of the fuel injectors usually is based on a map controller, which from a desired injection value, generates an actuation value for actuating the fuel injector with reference to a specified map. Usually, the map comprises characteristic curves which describe the control value in dependence on the desired injection value for several different pressures in the injection system. The maps or characteristic curves usually are stored in the controller in the form of tables, since the mostly relatively complex dependence of the control values on the desired injection values normally cannot be represented via a mathematical function.

With regard to the adaptation of the actuation of the fuel injectors, the usual procedure is to monitor the injection values during the ongoing engine operation and, when deviations from the desired injection values are detected, correspondingly adapt the map stored in the map controller.

It is known from German document DE 197 26 100 B4 to adapt the values within the map, which lie in an environment of the values for a fuel injection, which is to be used for the adaption of the map. The procedure, however, means a high expenditure, since a large number of values from the map permanently has to be corrected or adapted.

From German document DE 10 2008 051 820 A1 it is furthermore known to determine a quantity deviation of an actual injection quantity from a nominal injection quantity in operation of the fuel injector and with reference to this quantity deviation adapt a typical injection characteristic of the fuel injector to a nominal injection characteristic. The typical injection characteristic is shifted, rotated or adapted in its shape in at least one section. The typical injection characteristic thereby obtains a new shape or position, which comes close to the nominal injection characteristic. However, this procedure also means an extensive modification of the values for the characteristic curves. Furthermore, German document DE 10 2008 051 820 does not disclose a method of how a corresponding adaption of the typical characteristic curves can be performed efficiently.

SUMMARY OF THE INVENTION

It is one object of the present invention to provide a controller for an injection system that allows a simple and yet accurate adaptation of the actuation of the fuel injectors.

According to the invention, this object is achieved by a controller for an injection system which includes a plurality of fuel injectors. There is provided a map controller which from a desired injection value generates a control value for actuating a fuel injector with reference to a specified map. Furthermore, a determination unit is provided, which determines the actual injection value for at least one injection made with the fuel injector. Furthermore, an adaption unit is provided, which uses the results of the determination unit, in order to adapt the actuation of the fuel injectors. The adaption unit determines an adaption value for the injector actuation from the at least one actual injection value, and, in engine operation, the adaption unit receives the control values generated by the map controller as input and from the same generates adapted actuation values as output, by applying a first mathematical function to the control values generated by the map controller. The at least one adaption value is included in the first mathematical function as parameter.

The inventors of the present invention have recognized that for adapting the actuation of the injectors it is not necessary to change the map of the map controller. The map itself usually is very complex and cannot be described by simple mathematical functions. The drift of the map, however, i.e. the differences between different injectors of the same type, or the change in the injector behavior over time, have an influence on the injector map in a form which can be described very well by means of a simple mathematical function.

The present invention makes use of this fact in that it does not change the map controller of the control unit itself, but merely adapts the actuation value output by the map controller, in order to account for the drift in the map. With an extremely simple design of the controller, this nevertheless provides a very good accuracy during the injection.

The map controller, which from a desired injection value generates an actuation value for actuating the fuel injector with reference to a specified map, can be configured as known from the prior art. For several different pressures in the injection system, the map in particular can contain characteristic curves which describe the control value in dependence on the desired injection value. The maps or characteristic curves are stored in the controller for example in the form of tables. In particular, the maps or characteristic curves can represent a complex dependence of the control values on the desired injection values, which cannot be represented by means of a mathematical function, in particular not by means of an analytical function.

Advantageously, the map controller receives the injection values requested for the normal engine operation, in particular the requested injection quantities, as input and therefrom generates the actuation values, which according to the invention are adapted by the adaption unit, with reference to a map.

Advantageously, the controller comprises an engine control block which determines the requested injection values on the basis of engine operating conditions and/or control signals generated by the driver, in particular from the desired speed and/or the desired torque of the engine.

In a preferred embodiment, the adaption unit determines the at least one adaption value for the injector actuation by approximating the connection between the at least one actual injection value and the corresponding actuation value by a second mathematical function in which the at least one adaption value is included as parameter. In particular, the adaption unit can include an approximation function which determines the at least one adaption value, by which the second mathematical function optimally represents the connection between the at least one actual injection value and the corresponding actuation value.

The adaption value or values hence is/are determined in that the characteristic curve of the injector is approximated by the second mathematical function. Although the second mathematical function only very roughly represents the actual characteristic curve, at least one adaption value nevertheless can be calculated thereby with high reliability, by means of which the control values generated by the map controller can be adapted in the adaption unit according to the invention.

The second mathematical function, which describes the characteristic curve only relatively roughly, hence is not used as substitute of the characteristic curve stored in the map controller, but merely superimposed with the same, in order to compensate a drift of the characteristic curve.

Preferably, the adaption unit determines the at least one adaption value for the injector actuation on the basis of a plurality of actual injection values which correspond to different desired injection values. In particular, the injection values advantageously are distributed over a range of the characteristic curve of the injector.

Advantageously, the adaption unit approximates the connection between the several actual injection values and the corresponding actuation values by a second mathematical function in which the at least one adaption value is included as parameter. By using several actual injection values, the accuracy of the determination of the at least one adaption value can be increased.

Advantageously, the at least one adaption value is chosen such that the second mathematical function minimizes the connection between the actual injection values and the corresponding actuation values. Advantageously, there is used the method of least squares over the difference between the actual injection values and the injection values determined from the corresponding actuation values by means of the second mathematical function.

Furthermore, it can be provided that the first mathematical function additionally depends on at least one target adaption value. In particular, this target adaption value approximately can describe the map of the map controller.

Advantageously, it is provided that the connection between injection values and the corresponding control values expressed by the map of the map controller is approximated by a third mathematical function in which the at least one target adaption value is included as parameter.

The target adaption value hence provides for determining the drift of the maps by a comparison with the actual adaption values.

The at least one target adaption value can be stored in the adaption unit on the part of the manufacturer. Advantageously, the target adaption value is not changed during the operation of the engine controller.

According to the invention, it can furthermore be provided that the first mathematical function used by the control unit represents the deviation of a second mathematical function, which approximately describes the connection between the actual injection values and the corresponding actuation values, from a third mathematical function which approximately describes the connection between injection values and the corresponding control values expressed by the map controller. The mathematical function according to the invention hence describes the drift of the map controller, which can be described mathematically much more easily than the map itself.

According to the invention, the second and the third mathematical functions can be two identical functions except for the adaption values or target adaption values used as parameters. This means that for the case of a correspondence of adaption value and target adaption value the second and third mathematical functions also correspond with each other.

Advantageously, the first mathematical function also corresponds with the second and/or third functions/function except for the parameterization of the function.

Advantageously, each first to third function is an analytical function. Particularly preferably, each first to third function is a polynomial. The adaption values or target adaption values advantageously are the coefficients of the terms within the polynomial.

Advantageously, at least one of the first, the second, and the third mathematical functions is a polynomial of at least the first and maximally the fifth order. The drift in the map values still can be described thereby with relatively little effort. This effort, however, is sufficient, since the drift usually is not particularly complex.

Particularly preferably, at least one of the first, the second, and the third mathematical functions is a linear function which hence depends on two parameters.

Advantageously, the second and third mathematical functions hence approximate the connection between the injection values and the corresponding actuation values as a linear function. Furthermore advantageously, the first mathematical function describes an offset and a linear drift of the connection between the actual injection values and the corresponding actuation values as compared to the connection between injection values and the corresponding control values expressed by the map controller.

This relatively simple mathematical function already is sufficient to adapt the map controller to the drift with high accuracy.

According to the invention, the first mathematical function describes the drift in the actuation values determined by the map controller at least over a partial range of the entire value range of the actuation values. Particularly preferably, the first mathematical function describes the entire value range of the actuation values. In particular, there is no adaptation of different portions of the characteristic curve with different functions. In this way, a particularly simple and yet still sufficiently accurate adaptation is obtained.

Preferably, at least one of the second and third mathematical functions correspondingly approximates the characteristic curve at least over a partial range, and preferably over the entire actuation range.

Preferably, the at least one adaption value is determined recursively according to the invention. In particular, from an estimation of the at least one adaption value at a time n−1, a new estimate can be generated at the time n by means of a new measurement quantity.

According to the invention, the injection value can be the injection quantity and/or the injection duration and/or the injection start and/or the injection end.

Furthermore, the actuation value preferably can be the actuation duration and/or the actuation start and/or the actuation end of the fuel injector.

The map can represent the actuation duration of the fuel injector in dependence on the desired injection quantity, or the actuation start in dependence on the desired injection start.

Advantageously, at least one of the second and the third mathematical functions approximately describes the actual injection quantity or the target injection quantity in dependence on the actuation duration or vice versa the actuation duration in dependence on the actual injection quantity and/or the target injection quantity. In the same way, the second and the third functions of course also can represent the connection between injection start and actuation start.

According to the invention, the at least one adaption value can be determined with reference to injections which are made in the normal engine operation.

In a preferred embodiment, however, the at least one adaption value is determined with reference to at least one test injection. In this embodiment, the adaption values hence are not determined with reference to the injection anyway made during the ongoing engine operation, but with reference to test injections specifically made for this adaption.

Advantageously, several test injections are carried out with different desired injection values and are included in the determination of the adaption value. As a result, different measurement points can be approached via the characteristic curve, which provides for a better approximation of the second mathematical function to the actual characteristic curve and hence a more accurate determination of the adaption values.

The injection quantity of the test injections can lie between 2 mg and 80 mg, but more preferably lie between 5 mg and 50 mg. Too small injection quantities do not provide sufficiently accurate results, while too large injection quantities are difficult to integrate into the normal engine operation.

Furthermore, it can be provided that the test injections extend over a range of more than 10 mg, preferably of more than 20 mg, and more preferably of more than 30 mg.

Furthermore, the number of the different durations of actuation and/or injection quantities preferably lies between 2 and 20, and more preferably between 4 and 10.

Both factors contribute to achieving a relatively high accuracy of the adaption with a reasonable effort.

Advantageously, the determination unit performs at least one test injection with specified actuation values. Advantageously, the specified actuation values are independent of the actuation values desired for the normal engine operation.

Several test injection values or test actuation values can be stored in the controller, which are approached for carrying out the adaption in connection with test injections.

A test routine can be specifically adapted to the adaption, whereby a correspondingly better reproducibility and increased accuracy is achieved.

As basis for the correction of the injector actuation according to the invention a measurement signal can be used, from which the actual behavior of the injector under consideration can be derived. For this purpose, a wide variety of engine sensors can be used.

As an engine sensor, a pressure sensor can be used in the supply line of the fuel injector. A knock sensor can additionally or alternatively be used. Alternatively or in addition, the engine speed, the engine torque and/or the injector voltage also can be used as sensor signal. The actual injection value achieved on actuation with a particular actuation value can be determined from the measurement signal.

In particular, this can be the actual injection quantity and/or the actual injection duration and/or the actual injection start and/or the actual injection end of the injector actuation.

The determination performed by the determination unit can be carried out during the normal operation of the engine by making test injections in addition to the normal injections for the engine operation.

The test injection can be a pre-injection or post-injection effected before or after the main injection. To influence the engine operation as little as possible, the injection quantity of the test injection can be chosen below 100 mg, preferably below 50 mg. A typical test injection quantity for example can be 20 mg.

Advantageously, the controller according to the invention includes an activation unit which prompts the determination unit to start the evaluation operation and initiate a test routine in which at least one test injection is made. The activation of the determination unit for example can be effected in specified intervals.

A preferred embodiment of the controller according to the invention comprises a monitoring unit for monitoring the engine operation, which is connected with the determination unit such that the determination of the actually injected fuel quantity or the value derived therefrom is carried out by the determination unit in operating conditions of the engine suitable for the determination. In particular, transient operating conditions of the engine should be avoided, since the same can reduce the accuracy of the determination.

For example, it can be provided that the determination is performed at a constant target pressure in the common fuel supply line, and/or at a constant speed of the engine, and/or at constant injection values for the normal engine operation, and/or at a constant temperature in the common fuel supply line. This is advantageous in particular when several measurements and in particular several test injections are carried out, so that changes in the operating conditions would have an effect on the measurement.

or a value derived therefrom can be effected by the determination unit in response to an inquiry as to whether the speed of the engine operates below a certain speed threshold.

In particular, the monitoring unit can monitor the speed of the engine and only initiate a test routine, in which at least one test injection is made, when the speed lies below a certain speed threshold. Since the speed and the cycle length are inversely proportional to each other, the small speed has the advantage that between two main injections of the normal engine operation a correspondingly long time interval is left, in which the test injection can be carried out and a corresponding pressure measurement can be carried out. This allows to maintain the distance between main and test injection important for the accuracy of the measurement.

Particularly preferably, the determination is effected in the idle mode of the internal combustion engine.

In a preferred embodiment, the determination and adaption is effected individually for each fuel injector. Component tolerances as well as individual drifts of the properties of the fuel injectors thereby can be taken into account.

The injector-individual adaption can be achieved by a determination or use of injector-individual adaption values. For the actuation of all injectors on the other hand the same map can be used. In this case, the same target adaption values likewise can be used for all injectors.

Advantageously, the mathematical functions each used for actuating the plurality of injectors only differ with regard to the possibly different adaption values.

According to the invention, the map for implementing the map controller in particular can be stored in the engine controller only once. Likewise, the target adaption values also can be stored only once.

The adaption values which are included in the first mathematical function, on the other hand, advantageously are repeated during the engine operation and advantageously determined continuously and updated for each individual injector.

On the other hand, it can be provided that during the operation of the engine the map of the map controller is at least not adapted with regard to the adaption to the changing properties of the fuel injectors.

According to a further preferred embodiment, the determination and adaption is effected by the determination unit for several different operating points of the injection system and/or the engine. In particular, the determination can be effected for several different pressures in the common pressure line. Alternatively, the determination can be effected by measurements for only one operating point of the injection system and/or the engine, in particular for only one pressure in the common pressure line, while the adaption values for the remaining operating points are determined by an extrapolation.

According to a further preferred embodiment, the determination and adaption is effected by the determination unit for several different injection values of the fuel injector during the test injection.

Advantageously, the determination unit therefore comprises a test routine which carries out several different test injections and/or several test injections under different operating conditions of the pressure line and/or the engine.

The present invention furthermore comprises an injection system which comprises a plurality of fuel injectors. The common-rail injection system according to the invention furthermore includes a controller as it has been described above in detail.

Advantageously, this is a common-rail injection system which includes a plurality of fuel injectors, a common pressure line for the fuel injectors, a high-pressure pump for supplying the common pressure line with fuel, and a pressure sensor for determining the pressure in the common pressure line.

Furthermore, the present invention comprises an engine with such injection system according to the invention. In particular, this can be a diesel engine.

Furthermore, the present invention comprises a mobile implement with an engine according to the invention.

Also independent of the controller according to the invention, the present invention also comprises a method for controlling an injection system. For at least one injection made with a fuel injector, an actual injection value is determined, and the results of the determination unit are used to adapt the actuation of the fuel injectors. Furthermore, from the at least one actual injection value, at least one adaption value is determined for the injector actuation. In engine operation, a control value for actuating a fuel injector is generated from a desired injection value with reference to a specified map, and the control values generated by the map are adapted by applying a first mathematical function to the control values generated by the map controller, in which the at least one adaption value is included as parameter.

Advantageously, the actuation values, which according to the invention are adapted by the adaption unit, are generated by the map controller from the injection value requested for the normal engine operation, in particular from the injection quantity. The requested injection value preferably is determined on the basis of engine operating conditions and/or control signals generated by the driver, in particular from the desired speed and/or the desired torque of the engine.

Preferably, the method according to the invention is effected by a controller such as has already been discussed above in detail.

Advantageously, the inventive controller for the injection system is configured such that the controller carries out all steps and activities in an automated way. In particular, a corresponding computer program can be provided for this purpose, which is stored in a memory of the controller and comprises commands for carrying out the method according to the invention or for implementing the controller according to the invention.

The present invention also relates to such computer program, by which a method according to the invention or a controller according to the invention is implemented.

The present invention will now be explained in detail with reference to an exemplary embodiment and drawings.

DETAILED DESCRIPTION OF THE INVENTION

Figure 1:
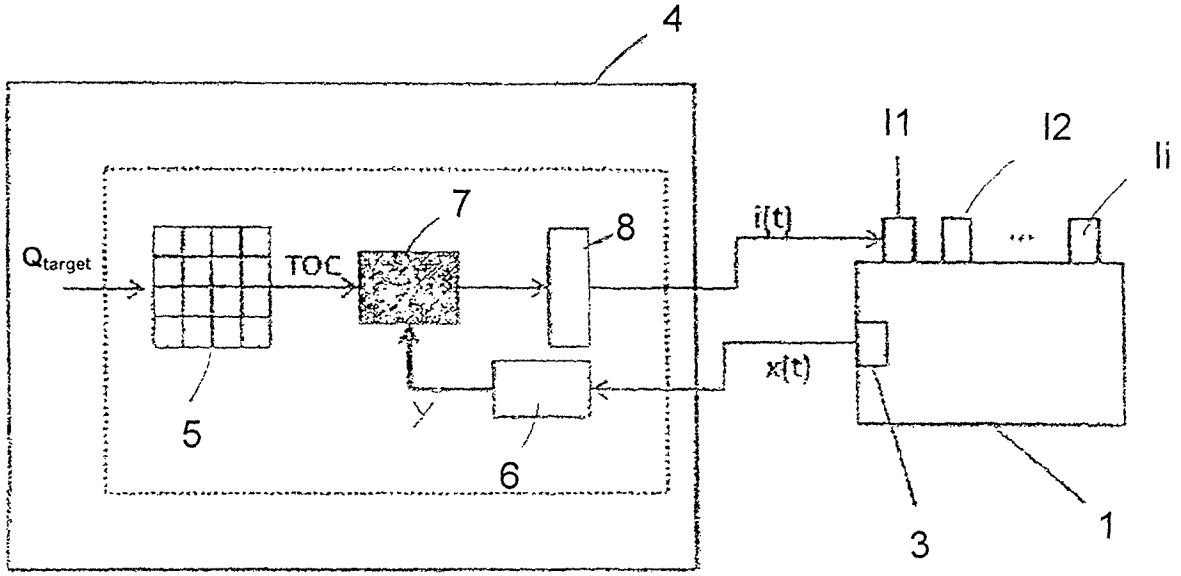
FIG. 1 shows an exemplary embodiment of an injection system according to the invention with an exemplary embodiment of an inventive controller.

FIG. 1 shows an exemplary embodiment of an engine according to the invention with an injection system according to the invention with an inventive controller.

The engine 1 includes an injection system with a plurality of injectors I1, I2 to Ii. Furthermore, a sensor 3 is provided, which provides a measurement value x(t).

The injection system can be a common-rail injection system, in which the injectors I1, I2 to Ii are supplied with pressurized fuel by a common fuel supply line. There can be provided a high-pressure pump which supplies the common fuel supply line with high pressure. Furthermore, the sensor 3 can be a pressure sensor for measuring the pressure in the common fuel supply line.

FIG. 1 furthermore shows a block diagram of an engine control unit 4 according to the invention. The same initially contains a conventional map controller 5 in which an actuation value TOO for the respective injector is determined from the injection value $Q_{target}$ requested for the engine operation with reference to a map. The requested injection value serving as input for the control block 5 is determined for example on the basis of engine operating conditions and/or control signals generated by the driver, in particular from the desired speed and/or the desired torque of the engine. The control block 5 can comprise either a common map for all injectors or injector-individual maps.

The engine control unit 4 furthermore comprises a determination unit 6, which from a measurement value determined by the at least one sensor 3 determines the actual injection value y during an injection, in particular a test injection. Furthermore, an adaption unit 7 is provided, which receives the actual injection value y as input.

From the at least one actual injection value, the adaption unit now determines at least one adaption value for the injector actuation, and uses this adaption value for adapting the actuation values output by the map controller 5 to the drift of the respective injector.

In normal engine operation, the adaption unit 7 receives the control values generated by the map controller 5 as input and from the same generates adapted actuation values as output, by applying a first mathematical function to the control values generated by the map controller, in which the at least one adaption value is included as parameter. The corrected actuation value then is supplied to the injector end stage 8, which generates the immediate electrical actuation signals for the injectors, which are transmitted to the same via a control line.

The exemplary embodiment of the controller according to the invention as shown in FIG. 1 will now be described in detail below.

The precise dosage of the injected fuel quantity plays an essential role with regard to the subsequent combustion and the exhaust gases generated thereby. Due to production-related component variances of the fuel injectors and aging phenomena during the engine operation, the same must be calibrated while the engine is running.

Fuel injectors are subject to production-related component variances which impair the dosing accuracy. The loading of the fuel system with higher and higher system pressures leads to additional component drifts, which entail negative effects on the emission behavior and the efficiency of the engine. To counteract these deviations, a correction of the injector actuation is necessary, in order to ensure stable running of the engine.

This means that deviations or drifts in the actually injected fuel quantity must be detected, quantified and compensated by a corresponding adaptation of the injector actuation.

By means of the controller according to the invention, deviations or inaccuracies in the injected fuel quantity can be compensated, which are due to the following reasons:

inaccuracies due to manufacturing tolerances aging phenomena or wear nozzle coking According to the invention a measurement signal x(t) forms the basis for the correction of the injector actuation, from which the actual behavior of the injector under consideration can be derived. Various engine sensors can be used for this purpose, e.g. the rail pressure sensor, knock sensors, the engine speed or also the injector voltage. How the actual behavior of the injector is determined from such sensor signal is not decisive for the realization of the present invention. In the following, it therefore is assumed that a measurement quantity y, such as the actual injection quantity $Q_{actual}$, the actual injection duration $TOI_{actual}$ or the actual injection start $SOI_{actual}$ is available to the injector actuation.

In the exemplary embodiment a map controller is used according to the invention, which on the basis of the desired injection quantity $Q_{target}$ outputs the necessary actuation duration $TOC_{target}$. The present invention now adapts this actuation duration $TOC_{target}$ by an injector-individual adaptation.

Figure 2:
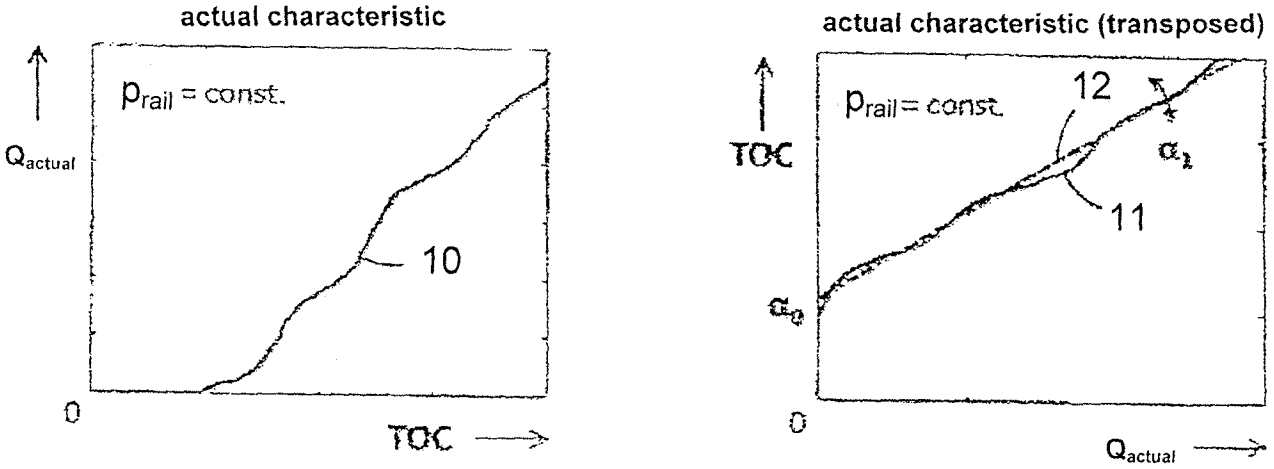
FIG. 2 shows diagrams of an injector-individual actual characteristic curve (left) and a transposed representation with linear approximation of the actual characteristic curve (right).

Such injector-individual adaptation of the injector control also would be satisfied completely when the respective actual injector characteristic curve ($TOC_{actual}$, $Q_{actual}$) for a given rail pressure $P_{rail}$ would be provided to the control unit, as is shown as characteristic curve 10 on the left side of FIG. 2. Such constant adaptation of the maps stored in the map controller, however, is not feasible, since for this purpose all actuation points ($TOC_{actual}$, $Q_{actual}$, $P_{rail}$) of the map would have to be approached for the injector calibration. According to the invention, there is therefore used a method of estimating the target-actual deviation without having to directly determine the entire characteristic curve ($TOC_{actual}$, $Q_{actual}$).

For this purpose, the following approach is pursued: The transposed representation 11 of the characteristic curve 10, as shown on the right in FIG. 2, is approximated by a linear approximation 12:

$$TOC = [\hat{Q}_{actual} \quad 1] \cdot \begin{bmatrix} \alpha_1 \\ \alpha_0 \end{bmatrix} + e \tag{1}$$

$Q_{actual}$ represents the estimate of the actual injection quantity, e the estimation error, and $\underline{\alpha}=[a_1\ \alpha_0]^T$ the parameterization of the linear approximation, which by means of a least-squares estimation can be determined from M independent measurements:

$$\underbrace{\begin{bmatrix} TOC_1 \\ \vdots \\ TOC_M \end{bmatrix}}_{\underline{y}} = \underbrace{\begin{bmatrix} \hat{Q}_{actual,1} & 1 \\ \vdots & \vdots \\ \hat{Q}_{actual,M} & 1 \end{bmatrix}}_{\underline{\Psi}} \cdot \underbrace{\begin{bmatrix} \alpha_1 \\ \alpha_0 \end{bmatrix}}_{\underline{\alpha}} + \underline{e} \tag{2}$$

$$\underline{\hat{\alpha}} = \begin{bmatrix} \hat{\alpha}_1 \\ \hat{\alpha}_0 \end{bmatrix} = (\underline{\Psi}^T \cdot \underline{\Psi})^{-1} \cdot \underline{\Psi}^T \cdot \underline{y} \tag{3}$$

This linear approximation represents a relatively poor approximation of the characteristic curve. However, since in the control strategy according to the invention not the characteristic curve itself, but merely its drift is to be quantified, this relatively poor approximation nevertheless is sufficient.

The correction of the drift then is effected by means of a comparison of the linear approximation of the characteristic curve with a linear approximation of the characteristic curve represented by the map controller, i.e. a target characteristic curve. The target characteristic curve is represented by the vector $\underline{\alpha}_{target}=[\alpha_{target1}\ \alpha_{target0}]^T$. Inserted into equation 1, this target adaption value $\underline{\alpha}_{target}$ approximates the characteristic curve stored in the map controller.

Thus, the corrected actuation duration is obtained from $$TOC^* = \frac{\alpha_{1,target}}{\hat{\alpha}_1} \cdot TOC + \left(\alpha_{0,target} - \frac{\alpha_{1,target}}{\hat{\alpha}_1} \cdot \hat{\alpha}_0\right) \tag{4}$$

The coefficients determined from the two vectors $\underline{\alpha}$ and $\underline{\alpha}_{target}$ in equation (4) hence express the offset and the linear distortion of the respectively approximated characteristic curve.

For a realization on a control unit, a recursive least-squares estimation is recommendable, which from an estimate $\underline{\alpha}_{N-1}$ at the time N−1 generates an estimate $\underline{\alpha}(N)$ with reference to the new measurement quantity x(N).

Such recursive LS estimation for example can be implemented as follows: A general LS estimator, as already set forth above, is based on equation (2):

$$\begin{bmatrix} TOC_1 \\ \vdots \\ TOC_M \end{bmatrix} = \begin{bmatrix} \hat{Q}_{1,actual} & 1 \\ \vdots & \vdots \\ \hat{Q}_{M,actual} & 1 \end{bmatrix} \cdot \begin{bmatrix} \alpha_1 \\ \alpha_0 \end{bmatrix} + \underline{e}$$

After m measurements, i.e. after the m th step, this equation can be represented by the measurement vector $\underline{y}(m)$, the regression vectors $\underline{\phi}(1)$ . . . $\underline{\phi}(m)$ or the regression matrix $\underline{\psi}(m)$:

$$\underline{y}(m) = \begin{bmatrix} \underline{\phi}(m) \\ \vdots \\ \underline{\phi}(1) \end{bmatrix} \cdot \begin{bmatrix} \alpha_1 \\ \alpha_0 \end{bmatrix} + \underline{e} = \begin{bmatrix} \underline{\phi}(m) \\ \Psi(m-1) \end{bmatrix} \cdot \begin{bmatrix} \alpha_1 \\ \alpha_0 \end{bmatrix} + \underline{e}$$

This means that with each new measurement, the conditional equation can be written as follows, when the m th measurement y(m) and the regression vector $\underline{\phi}(m)$ are added to the measurement vector $\underline{y}(m-1)=[y(m-1) \ldots y(1)]^T$ and the regression matrix $\underline{\Psi}(m-1)$:

$$\begin{bmatrix} y(m) \\ \underline{y}(m-1) \end{bmatrix} = \begin{bmatrix} \underline{\phi}(m) \\ \underline{\Psi}(m-1) \end{bmatrix} \cdot \begin{bmatrix} \alpha_1 \\ \alpha_0 \end{bmatrix} + \underline{e}$$

This now forms the approach to the recursive LS estimator. The RLS estimator consists of a weight vector $$\underline{k}(m)=P(m-1)\cdot\underline{\Phi}(m)[1+\phi(m)^T\cdot\underline{P}(m-1)\cdot\underline{\Phi}(m)]^{-1}$$

and the estimation error covariance $$\underline{P}(m)=\underline{P}(m-1)\cdot\underline{k}(m)\cdot\underline{\Phi}(m)^T\cdot\underline{P}(m-1)$$

On the basis of these auxiliary variables, which are recursively determined for each new measurement, the estimation is made for $\underline{\alpha}=[\alpha_1\ \alpha_0]^T$ $$\hat{\underline{\alpha}}(m)=\hat{\underline{\alpha}}(m-1)+\underline{k}(m)\cdot[y(m)-\underline{\Phi}(m)^T\cdot\hat{\underline{\alpha}}(m-1)]$$

In this way, a new estimate (step m) is determined on the basis of the preceding estimate (step m−1), of the weight vector and the estimation error covariance. According to experience, the starting value for the estimation error covariance is set to 10^3 . . . 10^5. In addition, it is possible to incorporate a forgetting factor which rates the estimates of preceding steps lower.

Figure 3:
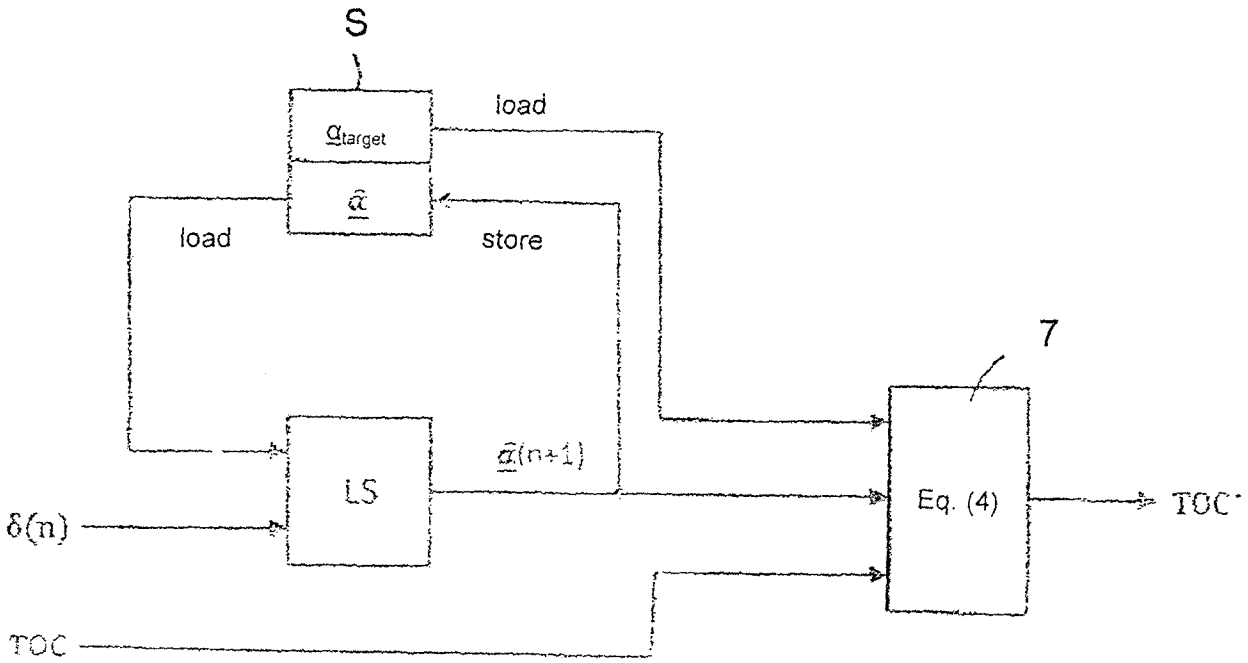
FIG. 3 shows an exemplary embodiment of an adaption unit according to the present invention.

An exemplary embodiment for the adaption unit according to the invention is shown in FIG. 3. The adaption unit 7 receives the actuation value TOO generated by the map controller 5 as input and from the same generates the corrected actuation value TOC* by means of equation 4. The adaption values a are determined via the recursive estimator LS, which by means of the previous estimation and a new measurement value x(N) estimates those adaption values a which allow an optimum approximation of the function 1 to the measurement values. In concrete terms, this is realized in that the estimation error e in equation 2 is minimized via the M measurement values.

The adaption unit 7 loads the target adaption values $\underline{\alpha}_{target}$ from the memory S. During the production of the controller according to the invention, the same already can be stored in the memory S and remain unchanged. Furthermore, the current values for $\underline{\alpha}$ each are stored in the memory S and read out for the next estimation.

The initialization of the memory S for the parameter vector of the adaption values $\underline{\alpha}$ likewise can be effected by the final inspection after the injector production, so that manufacturing tolerances already can be taken into account at the factory by $\underline{\alpha}$. Drifts occurring during the ongoing engine operation then are compensated by a corresponding update of $\underline{\alpha}$.

According to the invention, the same map in the map controller hence can be used for all injectors, whereas both manufacturing tolerances and drifts occurring during the operating period are compensated by the adaption unit alone. Correspondingly, the same value for $\underline{\alpha}_{target}$ then would also be used for all injectors.

Figure 4:
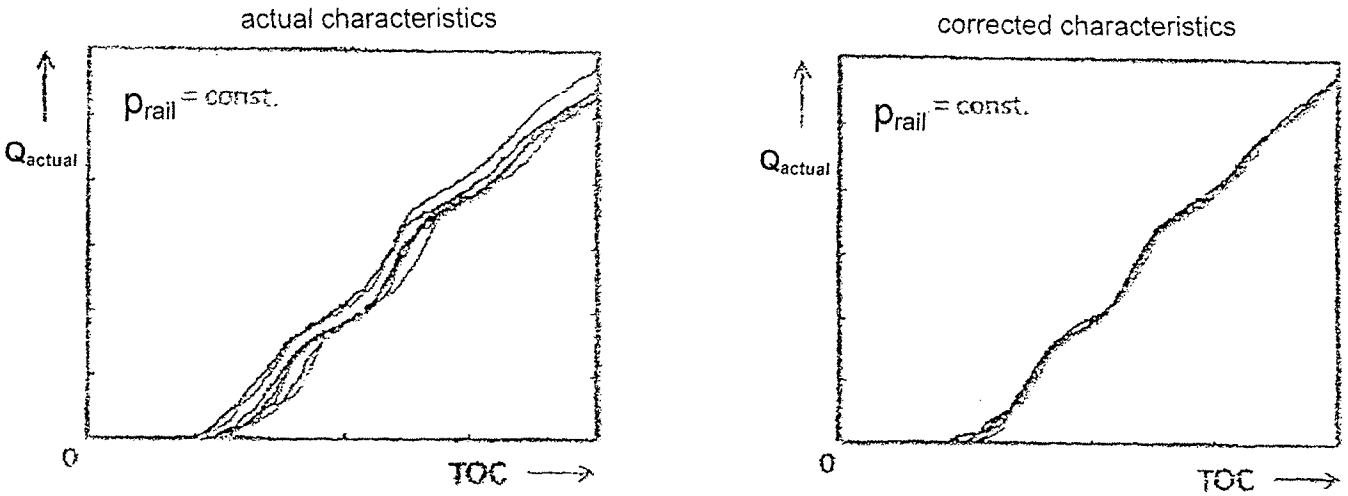
FIG. 4 shows diagrams of the actual characteristic curve of seven (7) brand-new injectors (left) and correspondingly corrected characteristic curves (right).

Despite the extremely simple construction and the uncomplicated realization, the adaption unit according to the invention allows an astonishingly accurate actuation of the injection quantity, as can be taken from the diagrams shown in FIG. 4.

The left image in FIG. 4 shows the individual actual characteristic curves of seven brand-new injectors. The same above all differ in an offset and a linear error in TOC, which can be compensated by the actuation according to the invention. On the right, corrected characteristic curves are shown, which result from the superposition of the characteristic curves shown on the left with the correction function according to the invention from equation 4.

The present invention hence allows an astonishingly accurate correction of the injection, without having to change the maps themselves for this purpose.

In the exemplary embodiment, the actuation duration TOC is chosen as actuation value for the injectors, without the present invention being limited to this concrete actuation value. Rather, exactly the same actuation also might be implemented as actuation value on the basis of the start of injector energization SOC (start of current). In this case, the underlying measurement quantity y would be the start of injection SOI.

Some important aspects of the controller according to the invention for compensating deviations and drifts in the actuation of an injection system will be described once again below independent of the exemplary embodiment described above:

The adaption means according to the invention provides that i) the production-related drift or the drift obtained during the injector life in an injection value, such as for example the injection quantity, the injection start or the injection end, is quantified by a parameter vector $\underline{\alpha}=[\alpha_1\ \alpha_0]^T$, which consists of an offset and a linear drift part, ii) the drift compensation is effected by adaptation of an actuation value received by the map controller, such as the actuation duration TOC or the start of injector energization SOC. The adapted actuation value such as for example the adapted actuation duration TOC* is a function of the actuation value requested by the map controller, such as for example the actuation duration TOC and the determined parameter vector $\underline{\alpha}=[\alpha_1\ \alpha_0]^T$, iii) wherein the parameter vector for example is recursively determined from a measurement of an actual injection value such as the actual injection quantity, the actual injection start and/or the actual injection end, wherein this can be effected for example with reference to an engine sensor signal and a speed signal, a knock signal or a pressure sensor signal.

Despite the simple construction, the present invention allows an astonishingly good adaptation of the injection behavior to the injector-individual drift.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A controller for an injection system, which includes a plurality of fuel injectors, comprising:

a map controller, which, from a desired injection value, generates a control value for actuating a fuel injector with reference to a specified map, a determination unit, which determines an actual injection value for at least one injection made with the fuel injector, and an adaption unit, which uses results from the determination unit in order to adapt actuation of the fuel injectors, wherein the adaption unit determines at least one adaption value for injector actuation from the actual injection value, wherein, in engine operation, the adaption unit receives the control value generated by the map controller as input and from the same generates an adapted actuation value as output by applying a mathematical function to the control values generated by the map controller, and wherein the at least one adaption value is included in the mathematical function as parameter.

2. The controller according to claim 1, wherein the mathematical function is a first mathematical function, and the adaption unit determines the at least one adaption value for the injector actuation by approximating a connection between the at least one actual injection value and a corresponding actuation value by a second mathematical function in which the at least one adaption value is included as parameter.

3. The controller according to claim 2, wherein the first mathematical function additionally depends on at least one target adaption value, and wherein the connection between injection values and the corresponding control values expressed by the map of the map controller is approximated by a third mathematical function, in which the at least one target adaption value is included as parameter and/or stored in the adaption unit on the part of the manufacturer.

4. The controller according to claim 3, wherein at least one of the first, second, and third mathematical functions is a linear function, which depends on two parameters, and wherein the first mathematical function describes an offset and a linear drift of the connection between the actual injection values and the corresponding actuation values as compared to the connection between injection values and the corresponding control values expressed by the map controller.

5. The controller according to claim 2, wherein the at least one adaption value is determined recursively.

6. The controller according to claim 2, wherein the injection value is at least one of an injection quantity, an injection start, and an injection end, and wherein the actuation value is at least one of an actuation duration, an actuation start, and an actuation end of the fuel injector.

7. The controller according to claim 2, wherein the at least one adaption value is determined by way of at least one test injection, and wherein several test injections are carried out with different desired injection values and are included in determination of the adaption value.

8. The controller according to claim 7, wherein the determination unit performs the at least one test injection with specified actuation values, wherein the specified actuation values are independent of actuation values desired for the normal engine operation, and wherein the at least one test injection is made before or after a main injection.

9. The controller according to claim 1, wherein the mathematical function is a first mathematical function, wherein the adaption unit determines the at least one adaption value for the injector actuation based on a plurality of actual injection values, which correspond to different desired injection values, and wherein the adaption unit approximates the connection between the actual injection values and the corresponding actuation values by a second mathematical function in which the at least one adaption value is included as parameter.

10. The controller according to claim 9, wherein the first mathematical function additionally depends on at least one target adaption value, and wherein the connection between injection values and the corresponding control values expressed by the map of the map controller is approximated by a third mathematical function, in which the at least one target adaption value is included as parameter and/or stored in the adaption unit on the part of the manufacturer.

11. The controller according to claim 1, wherein the mathematical function is a first mathematical function that approximately represents the deviation of a second mathematical function, which describes a connection between actual injection values and corresponding actuation values, from a third mathematical function which approximately describes a connection between the injection values and corresponding control values expressed by the map controller.

12. The controller according to claim 1, wherein the at least one adaption value is determined recursively.

13. The controller according to claim 1, wherein the injection value is at least one of an injection quantity, an injection start, and an injection end, and wherein the actuation value is at least one of an actuation duration, an actuation start, and an actuation end of the fuel injector.

14. The controller according to claim 1, wherein the at least one adaption value is determined by way of at least one test injection, and wherein several test injections are carried out with different desired injection values and are included in determination of the adaption value.

15. The controller according to claim 14, wherein the determination unit performs the at least one test injection with specified actuation values, wherein the specified actuation values are independent of actuation values desired for the normal engine operation, and wherein the at least one test injection is made before or after a main injection.

16. The controller according to claim 1, further comprising a monitoring unit for monitoring the engine operation that is connected with the determination unit such that determination of the at least one actual injection value by the determination unit is carried out in engine operating conditions suitable for that determination, including any of at a constant pressure in a common fuel supply line, at a constant speed, and at constant injection values for the normal engine operation, wherein the determination is effected over several engine cycles.

17. The controller according to claim 1, wherein the actual injection value determination and the fuel injector actuation adaption are effected individually for each fuel injector.

18. An injection system comprising:

a plurality of fuel injectors, and a controller having a map controller, which, from a desired injection value, generates a control value for actuating a fuel injector with reference to a specified map, a determination unit, which determines an actual injection value for at least one injection made with the fuel injector, and an adaption unit, which uses results from the determination unit in order to adapt actuation of the fuel injectors, wherein the adaption unit determines at least one adaption value for injector actuation from the actual injection value, wherein, in engine operation, the adaption unit receives the control value generated by the map controller as input and from the same generates an adapted actuation value as output by applying a mathematical function to the control values generated by the map controller, wherein the at least one adaption value is included in the mathematical function as parameter, and wherein the injection system is a common-rail injection system with a common fuel supply line for the fuel injectors, and a high-pressure pump for supplying the common fuel supply line with fuel.

19. An engine having a common-rail injection system according to claim 18.

20. A method for actuating an injection system having a plurality of fuel injectors using a controller for the injection system that includes a map controller, which, from a desired injection value, generates a control value for actuating a fuel injector with reference to a specified map, a determination unit, which determines an actual injection value for at least one injection made with the fuel injector, and an adaption unit, which uses results from the determination unit in order to adapt actuation of the fuel injectors, the method comprising:

determining an actual injection value for at least one injection made with the fuel injector, determining at least one adaption value for the injector actuation from the at least one actual injection value, in engine operation, generating a control value for actuating a fuel injector from a desired injection value with reference to a specified map, and adapting the control values generated by the map, applying a mathematical function, in which the at least one adaption value is included as parameter, on the control values generated by the map controller, and adapting actuation of the fuel injectors using results from the determination unit.

* * * * *